US006572159B2

(12) United States Patent
Lambertz et al.

(10) Patent No.: US 6,572,159 B2
(45) Date of Patent: Jun. 3, 2003

(54) DAMPED ACTUATING SYSTEM FOR MOTOR-VEHICLE DOOR LATCH

(75) Inventors: Karl Lambertz, Troy, MI (US); Ronald Toranto, Rochester Hills, MI (US)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/847,853

(22) Filed: May 2, 2001

(65) Prior Publication Data

US 2002/0036409 A1 Mar. 28, 2002

Related U.S. Application Data

(60) Provisional application No. 60/201,707, filed on May 3, 2000.

(51) Int. Cl.[7] ..... E05B 3/00

(52) U.S. Cl. ..... 292/336.3; 292/39; 292/51; 292/112; 292/160; 292/199; 74/543; 74/545; 16/412

(58) Field of Search ..... 292/336.3, 39, 292/51, 112, 160, 199; 74/543, 545; 16/412

(56) References Cited

U.S. PATENT DOCUMENTS 2,699,353 A * 1/1955 Nagy et al. ..... 292/336.3
4,342,135 A * 8/1982 Matsuo et al. ..... 16/82
4,426,752 A * 1/1984 Nakayama ..... 16/82
4,638,528 A * 1/1987 Omata ..... 16/82
4,766,619 A * 8/1988 Takeda ..... 4/251
4,982,303 A * 1/1991 Krenz ..... 360/137
5,001,809 A * 3/1991 Kim et al. ..... 16/62
5,092,642 A * 3/1992 Lindmayer et al. ..... 292/336.3
5,329,869 A * 7/1994 Freeman et al. ..... 114/117
5,441,005 A * 8/1995 Freeman et al. ..... 114/117
5,681,068 A 10/1997 Kleefeldt
5,743,575 A 4/1998 McFarland
6,182,483 B1 * 2/2001 von Kathen et al. ..... 70/208
6,264,257 B1 * 7/2001 Meinke ..... 292/336.3
6,367,124 B1 * 4/2002 Bella et al. ..... 16/412

* cited by examiner

*Primary Examiner*—Robert J. Sandy
*Assistant Examiner*—Carlos Lugo
(74) *Attorney, Agent, or Firm*—Herbert Dubno; Andrew Wilford

(57) ABSTRACT

The actuating system has a handle pivoted about a handle axis on the door, an actuating part fixed on the handle and extending radially from the axis, and a damper fixed on the door adjacent the axis and having an input element. The actuating part is connected to the input element for displacement of the input element and operation of the damper on pivoting of the handle. The input element is rotatable about a damper axis and the connection is a positive rotational coupling. The coupling includes gear teeth on the actuating part and gear teeth on the rotary input meshing with the actuating-part gear teeth. More specifically the rotary input element is a gear wheel and the actuating part includes a sector gear in mesh with the gear wheel.

16 Claims, 3 Drawing Sheets

DAMPED ACTUATING SYSTEM FOR MOTOR-VEHICLE DOOR LATCH

CROSS REFERENCE TO RELATED APPLICATION

The present application is related to provisional application No. 60/201,707 filed May 3, 2000.

FIELD OF THE INVENTION

The present invention relates to a motor-vehicle door latch. More particularly this invention concerns a damped actuating system for such a latch.

BACKGROUND OF THE INVENTION

A motor-vehicle door latch mounted in a motor-vehicle door (which term is here also intended to cover a trunk lid or hood) is typically actuated by an element that is formed as a handle. The handle is pulled on the outside of the door to unlatch and open the door and is similarly pulled on the inside of the door to unlatch the door and allow it to be pushed open.

The handle is normally spring loaded to return to its starting position once released. In order to prevent this action from damaging the structure or creating an annoying noise, it was standard to provide an elastomeric bumper to stop the handle's return movement somewhat more gently than just allowing the hard parts to come together. This system was replaced as described in U.S. Pat. No. 5,092,642 with an arrangement using a hydraulic damper which was coupled to the mechanism and which was effective on the return movement to slow this movement and bring the handle to a gentle rest. The damper comprises a closed housing filled with a viscous liquid and provided with a wheel having radially projecting vanes cooperating with at least one other vane fixed in the housing so that when the wheel is forcibly rotated, the liquid is forced through a small gap or orifice between the vanes.

When the latch-actuating element is set up as described in U.S. Pat. No. 5,681,068 so that it performs an unlocking/unlatching function when moved in one direction, normally outward from the door, and another function, normally locking, when pushed inward, it is possible for the released handle to overtravel and move inward. Thus if the handle is pulled all the way out and released suddenly, it will go all the way in and lock the door, which is frequently not desired.

Another system is described in U.S. Pat. No. 5,743,575 which has a hydraulic damper mounted right at the pivot for a pull-type outside door handle. Such a damper is highly effective but difficult to install. Furthermore setting it up for different damping characteristics or otherwise varying the installation is virtually impossible.

OBJECTS OF THE INVENTION

It is therefore an object of the present invention to provide an improved damped actuating system for a motor-vehicle door latch.

Another object is the provision of such an improved damped actuating system for a motor-vehicle door latch which overcomes the above-given disadvantages, that is which is of simple construction, which can be installed and modified easily, and which effectively prevents inward overtravel of the actuating element it is connected to.

SUMMARY OF THE INVENTION

The actuating system according to the invention has a handle pivoted about a handle axis on the door, an actuating part fixed on the handle and extending radially from the axis, and a damper fixed on the door adjacent the axis and having an input element. The actuating part is connected to the input element for displacement of the input element and operation of the damper on pivoting of the handle. According to the invention the input element is rotatable about a damper axis and the connection is a positive rotational coupling.

In accordance with the invention the coupling includes gear teeth on the actuating part and gear teeth on the rotary input meshing with the actuating-part gear teeth. More specifically the rotary input element is a gear wheel and the actuating part includes a sector gear in mesh with the gear wheel. Alternately the rotary input element is a wheel and the actuating part includes a wheel centered on the handle axis with a flexible transmission element reeved over the wheels and coupling them together. With either system changing of the relative diameters of the gears or wheels changes the transmission ratio and thereby allows the damping characteristic to be changed.

The door according to the invention is formed with a seat provided with means for releasably retaining the damper in the seat. This retaining means includes two elastically deformable arms defining the seat and gripping the damper. Thus mounting the damper simply entails snapping it into place. The damper can be supplied separately and easily installed in the latch, and replaced if necessary.

The damper seat can be adjustable for different transmission ratios between the actuating part and the input element. This can be done by providing a plurality of seats at different spacing, or means for moving the damper in one seat.

The damper in accordance with the invention includes a housing, a body of liquid in the housing, means defining an orifice in the housing, and at least one vane connected to the input element for forcing the liquid through the orifice on displacement of the input element. The liquid can be changed to vary the damping characteristic of the unit.

The rotary input element can include a one-way clutch by means of which it is connected to the actuating element so that the damper is only effective in one direction of movement of the handle relative to the door. Similarly a one-way valve could be provided in the damper to provide unidirectional damping action, with free movement in the opposite direction, normally the opening direction of the handle.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
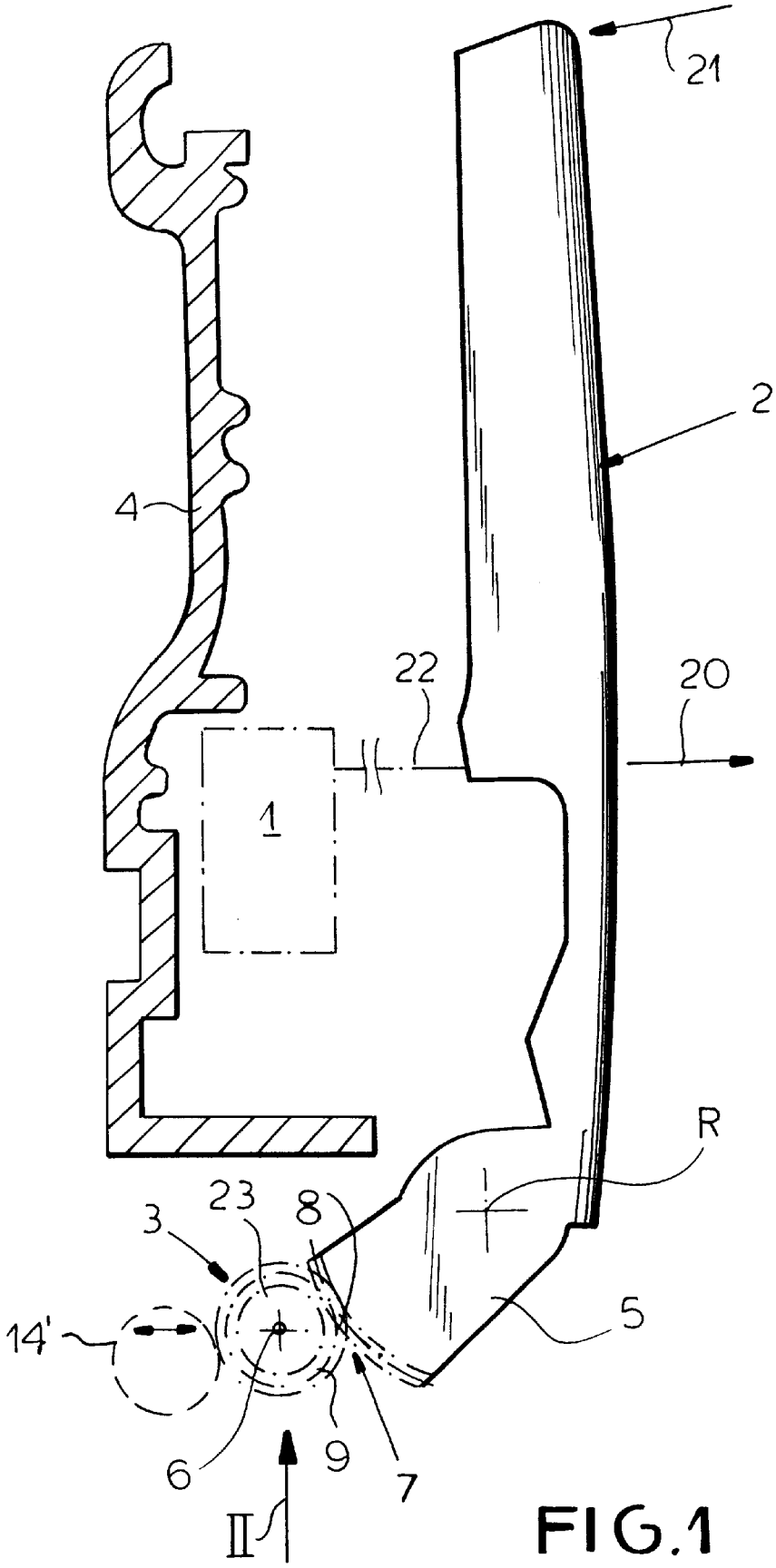
FIG. 1 is a partly diagrammatic and sectional top view of the system of this invention.

As seen in FIG. 1 a motor-vehicle door latch 1 is mounted in a door shown partially at 4 and is connected via a link shown schematically at 22 to a handle 2 rotatable about an axis R in an outward direction 20 to unlatch and open the door 4 and in an inward direction 21 to lock the door 4. According to the invention the handle 4 is formed unitarily with an actuating part 5 extending radially from the axis R and formed on its outer end as a sector gear with teeth 8. It is possible for this part 5 to be a separate element, but it must be fixed on the handle 2.

A damper 3 fixed in a seat 14 (FIG. 2) on the door 4 has an input shaft 6 carrying a gear wheel 23 formed with teeth 9 meshing with the teeth 8 and forming therewith a positive coupling 7. Thus the damper 3 will limitedly impede movement of the handle 2 about the axis R, preventing it from snapping back rapidly when released after being pulled outward in the direction 20.

Figure 4:
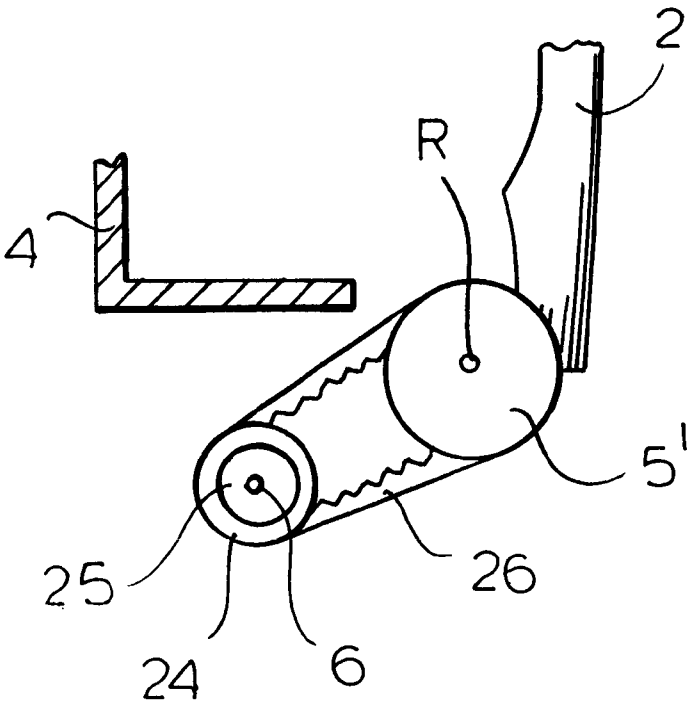
FIG. 4 is a partial view like FIG. 1 illustrating an alternative embodiment of the invention.

Instead of a gear coupling 7 the actuating part could be formed as shown in FIG. 4 as a roller or wheel 5' connected via a toothed belt 26 or the like to another wheel 24 connected via a one-way clutch 25 to the shaft 6. Instead of the belt 26, the wheel 5' could bear directly radially on the wheel 24 for a direct positive friction connection. The clutch 25 only transmits rotation from the wheel 5' to the shaft 6 on inward movement in the direction 21 of the handle 2, so the handle 2 can be pulled out as fast as the user wants; only inward movement in the direction 21 is damped.

Figure 3:
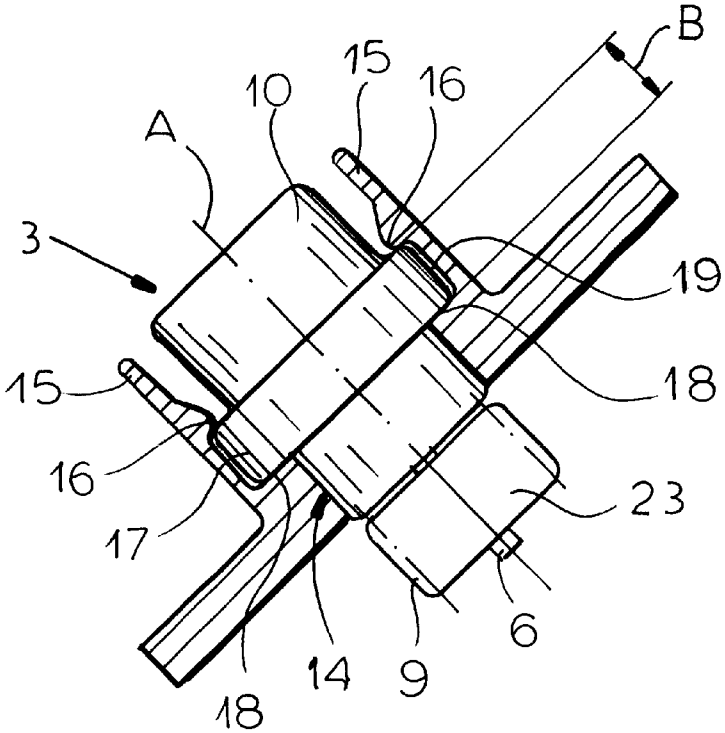
FIG. 3 is a section taken along line III—III of FIG. 2.
Figure 2:
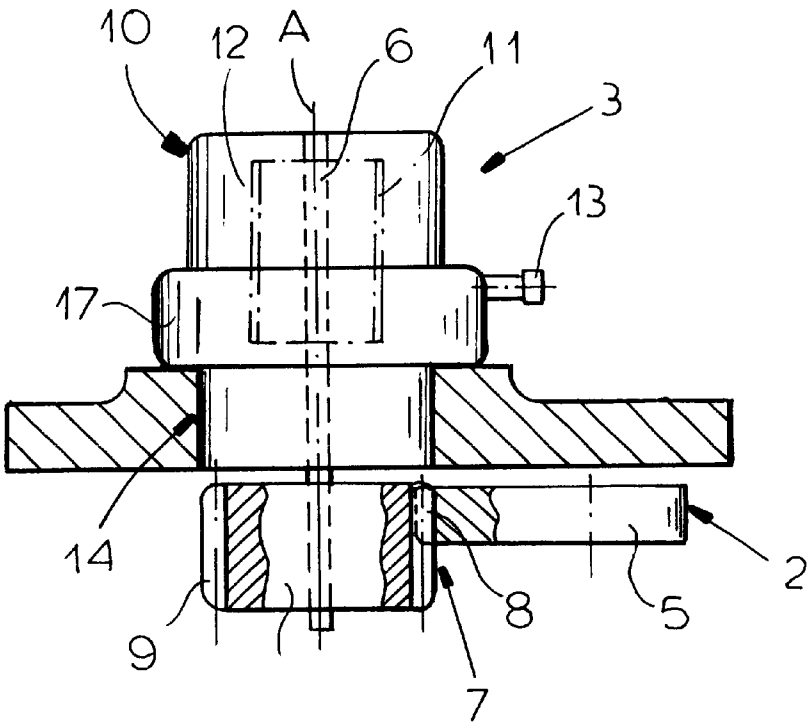
FIG. 2 is a view taken in the direction of arrow II of FIG. 1.
Figure 5:
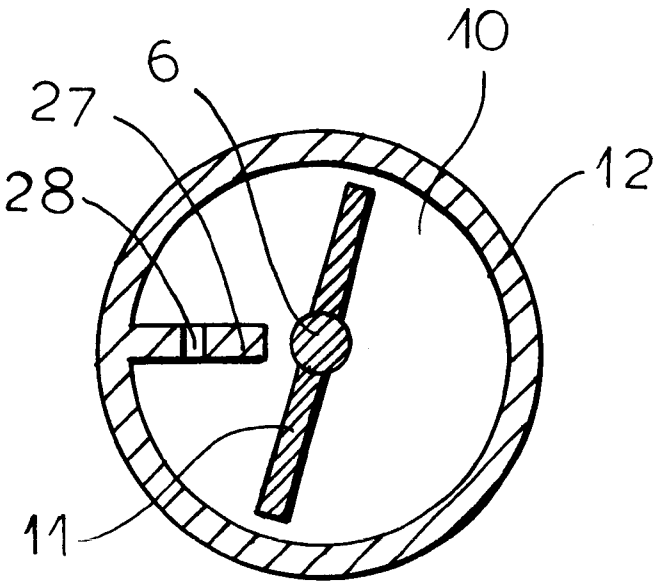
FIG. 5 is a section illustrating the damper in accordance with the invention.

The damper 3 as shown in FIGS. 2, 3, and 5 comprises a basically cylindrical housing 10 having a large-diameter collar 17 and forming a liquid-filled chamber 12 in which a paddle 11 fixed on the shaft 6 can rotate. The housing 10 may have a partition or vane 27 formed with an orifice 28 through which the liquid in the chamber 12 is forced as the paddle 11 rotates.

The seat 14 has a shoulder 18 bearing against one end of the collar 17 and is formed with two elastically deflectable arms 15 extending parallel to the damper axis A and formed with barbs 16 that engage over the back edge of the collar 17 and define a space 19 of a dimension B that exactly conforms to the axial length of this collar 17. A closable fill/drain opening 13 is provided for filling the chamber 12 with liquid and, if necessary changing this liquid with one of greater or lesser viscosity to alter the damping characteristic of the damper 3.

Thus after the handle 2 is mounted in place, the damper 3 can be simply pushed into the seat 14. This action automatically brings the teeth 8 and 9 into mesh and makes the arms 15 snap in place over the housing 10, all that is necessary for a permanent but releasable mounting of the damper 3. The door 4 may be provided with other seats such as shown in FIG. 1 at 14' for dampers with larger or smaller gear wheels 23 to change the amount of damping action.

We claim:

1. In a motor-vehicle door provided with a latch and formed with a seat, an actuating system comprising:

a handle pivoted about a handle axis on the door;

an actuating part fixed on the handle and extending radially from the axis;

a damper fixed on the door adjacent the axis and having an input element;

means including two elastically deformable arms defining the seat and gripping the damper for releasably retaining the damper in the seat; and means connecting the actuating part to the input element for displacement of the input element and operation of the damper on pivoting of the handle.

2. The door-latch actuating system defined in claim 1 wherein the input element is rotatable about a damper axis, the means being a positive rotational coupling.

3. The door-latch actuating system defined in claim 2 wherein the coupling includes gear teeth on the actuating part and gear teeth on the rotary input meshing with the actuating-part gear teeth.

4. The door-latch actuating system defined in claim 2 wherein the rotary input element is a gear wheel and the actuating part includes a sector gear in mesh with the gear wheel.

5. The door-latch actuating system defined in claim 2 wherein the rotary input element is a wheel, the actuating part includes a wheel centered on the handle axis, and the coupling is a flexible transmission element reeved over the wheels.

6. The door-latch actuating system defined in claim 1 wherein the damper seat is adjustable for different transmission ratios between the actuating part and the input element.

7. The door-latch actuating system defined in claim 1 wherein the damper includes a housing, a body of liquid in the housing, means defining an orifice in the housing, and at least one vane connected to the input element for forcing the liquid through the orifice on displacement of the input element.

8. The door-latch actuating system defined in claim 1 wherein the rotary input element includes a one-way clutch by means of which it is connected to the actuating element so that the damper is only effective in one direction of movement of the handle relative to the door.

9. In a motor-vehicle door provided with a latch and formed with a seat, an actuating system comprising:

a handle pivoted about a handle axis on the door;

an actuating part fixed on the handle and extending radially from the axis;

a damper fixed on the door adjacent the axis and having an input element;

means at the seat for releasably retaining the damper in the seat; and means connecting the actuating part to the input element for displacement of the input element and operation of the damper on pivoting of the handle, the seat being adjustable for different transmission ratios between the actuating part and the input element.

10. The door-latch actuating system defined in claim 9 wherein the input element is rotatable about a damper axis, the means being a positive rotational coupling.

11. The door-latch actuating system defined in claim 10 wherein the coupling includes gear teeth on the actuating part and gear teeth on the rotary input meshing with the actuating-part gear teeth.

12. The door-latch actuating system defined in claim 11 wherein the rotary input element is a gear wheel and the actuating part includes a sector gear in mesh with the gear wheel.

13. The door-latch actuating system defined in claim 11 wherein the rotary input element is a wheel, the actuating part includes a wheel centered on the handle axis, and the coupling is a flexible transmission element reeved over the wheels.

14. The door-latch actuating system defined in claim 9 wherein the retaining means includes two elastically deformable arms defining the seat and gripping the damper.

15. The door-latch actuating system defined in claim 9 wherein the damper includes a housing, a body of liquid in the housing, means defining an orifice in the housing, and at least one vane connected to the input element for forcing the liquid through the orifice on displacement of the input element.

16. The door-latch actuating system defined in claim 9 wherein the rotary input element includes a one-way clutch by means of which it is connected to the actuating element so that the damper is only effective in one direction of movement of the handle relative to the door.

* * * * *